US009543052B2

(12) United States Patent
Jackson

(10) Patent No.: US 9,543,052 B2
(45) Date of Patent: Jan. 10, 2017

(54) CONTAINING/TRANSPORTING CHARGED PARTICLES

(75) Inventor: Gerald Peter Jackson, West Chicago, IL (US)

(73) Assignee: HBAR TECHNOLOGIES, LLC, West Chicago, IL (US)

( * ) Notice: Subject to any disclaimer, the term of this patent is extended or adjusted under 35 U.S.C. 154(b) by 808 days.

(21) Appl. No.: 11/590,036

(22) Filed: Oct. 30, 2006

(65) Prior Publication Data

US 2007/0114380 A1 May 24, 2007

Related U.S. Application Data

(60) Provisional application No. 60/731,971, filed on Oct. 31, 2005.

(51) Int. Cl.
*G21K 1/00* (2006.01)

(52) U.S. Cl.
CPC ..... *G21K 1/003* (2013.01)

(58) Field of Classification Search
None
See application file for complete search history.

(56) References Cited

U.S. PATENT DOCUMENTS 4,665,340 A * 5/1987 Odenthal ..... H01J 29/84 313/240
4,867,939 A * 9/1989 Deutch ..... G21K 1/00 376/156
5,175,075 A * 12/1992 Frazier ..... G03F 7/2065 216/48
5,206,506 A * 4/1993 Kirchner ..... G21K 1/003 250/281
5,262,651 A * 11/1993 Bradshaw ..... G03F 7/2065 250/492.2
5,493,595 A * 2/1996 Schoolman ..... A61B 6/462 348/E13.008
5,772,404 A * 6/1998 Carella ..... F04B 37/02 417/313
5,783,824 A * 7/1998 Baba ..... H01J 49/423 250/281
5,977,554 A * 11/1999 Smith ..... G21K 1/003 250/493.1
6,160,263 A * 12/2000 Smith ..... G21K 1/003 250/493.1
6,237,363 B1 * 5/2001 Zollinger ..... A61K 49/1815 600/420
6,322,720 B1 * 11/2001 Reutova ..... B22F 9/20 252/181.6
6,398,980 B1 * 6/2002 Reutova ..... B22F 9/20 252/181.6
6,414,331 B1 * 7/2002 Smith ..... G21F 5/10 250/493.1

(Continued)

FOREIGN PATENT DOCUMENTS

JP 01151786 A * 6/1989 ..... F04B 37/08

*Primary Examiner* — Andrew Smyth
(74) *Attorney, Agent, or Firm* — Peter K. Trzyna, Esq.

(57) ABSTRACT

Particle storing apparatus including only one electric field restraining charged particles, such as antiprotons, in an ultrahigh vacuum from striking a container surface for a half-life of at least 1 hour. Depending on implementation, restraining can be devoid of a magnetic field, and the container can be devoid of cryogenic cooling or need not include a dewar.

86 Claims, 4 Drawing Sheets

Calculated electric field distribution associated with the electrostatic bottle in Figure 2, wherein the electric field is indicated using contours of constant potential.

(56) References Cited

U.S. PATENT DOCUMENTS

| | | | | |
|---|---|---|---|---|
| 6,427,452 | B2 * | 8/2002 | Zollinger | A61K 49/1815 600/5 |
| 6,537,825 | B1 * | 3/2003 | Zollinger | A61K 49/1815 436/173 |
| 6,543,236 | B2 * | 4/2003 | Zollinger | A61K 49/1815 222/3 |
| 6,551,559 | B1 * | 4/2003 | Cates, Jr. | A61K 49/1815 215/12.2 |
| 6,576,916 | B2 * | 6/2003 | Smith | G21K 1/003 250/493.1 |
| 6,606,370 | B1 * | 8/2003 | Kasprowicz | G21F 5/00 376/113 |
| 6,667,008 | B2 * | 12/2003 | Zollinger | A61K 49/1815 422/173 |
| 6,683,747 | B2 * | 1/2004 | Bernett | G11B 25/043 360/97.22 |
| 6,813,330 | B1 * | 11/2004 | Barker | G21K 1/003 250/251 |
| 6,822,405 | B2 * | 11/2004 | Jackson | A61N 5/10 315/503 |
| 6,838,676 | B1 * | 1/2005 | Jackson | G21K 1/093 250/294 |
| 2002/0179858 | A1 * | 12/2002 | Smith | G21K 1/003 250/493.1 |
| 2003/0081349 | A1 * | 5/2003 | Bernett | G11B 25/043 360/97.22 |
| 2003/0183783 | A1 * | 10/2003 | Smith | G21K 1/003 250/493.1 |
| 2003/0210002 | A1 * | 11/2003 | Jackson | A61N 5/10 315/503 |
| 2004/0162457 | A1 * | 8/2004 | Maggiore | A61N 5/10 600/1 |
| 2006/0039521 | A1 * | 2/2006 | Schaefer | B82Y 30/00 376/158 |

* cited by examiner

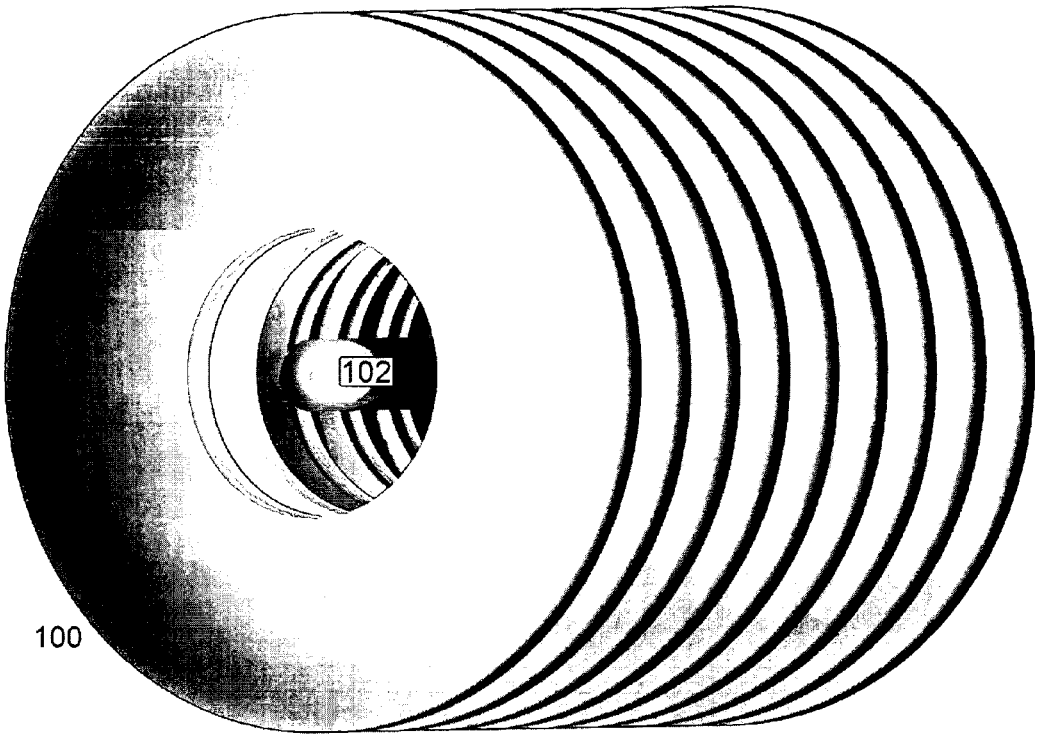
Figure 1: Axisymmetric electrodes surrounding a distribution of charged particles.
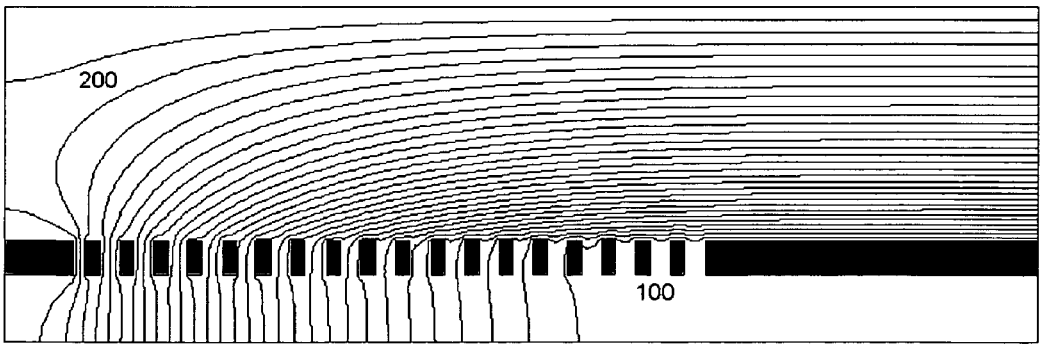
Figure 2: Electrostatic bottle drawing with representative subsystems describing a possible embodiment of an apparatus for storing and transporting charged particles.

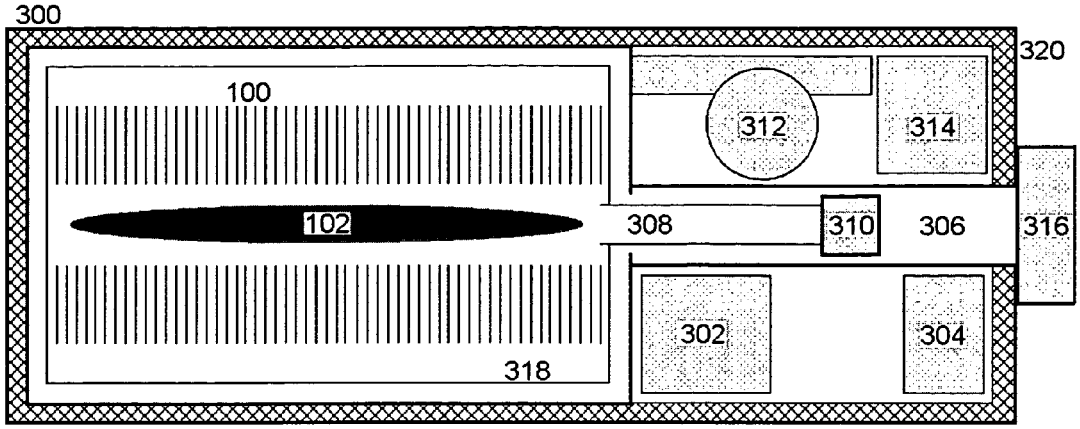
Figure 3: Calculated electric field distribution associated with the electrostatic bottle in Figure 2, wherein the electric field is indicated using contours of constant potential.
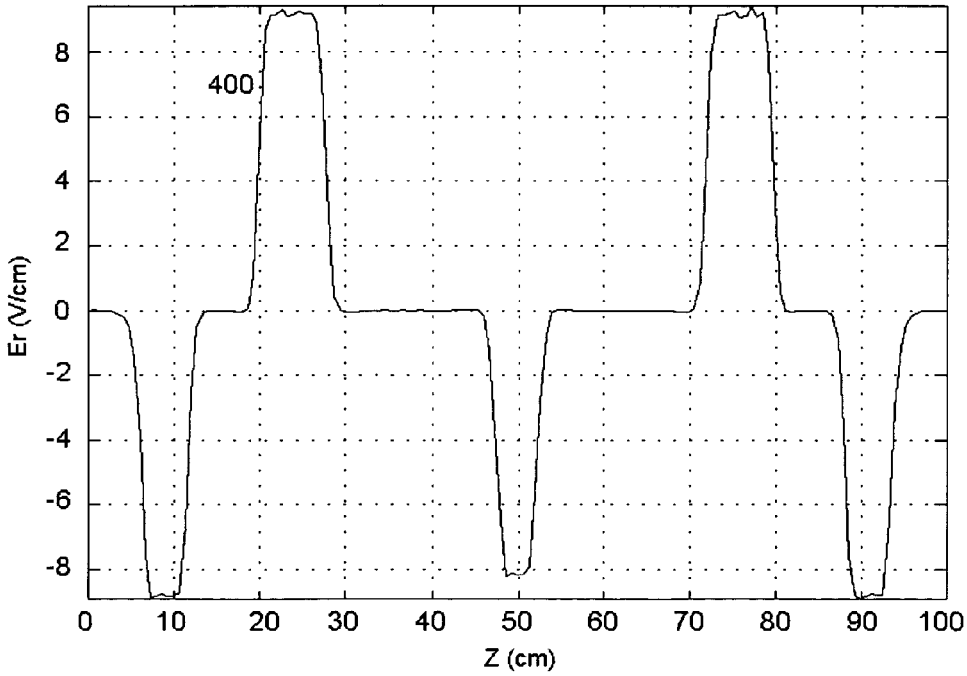
Figure 4: Calculated radial electric field on the central axis of the electrostatic bottle in Figure 2.

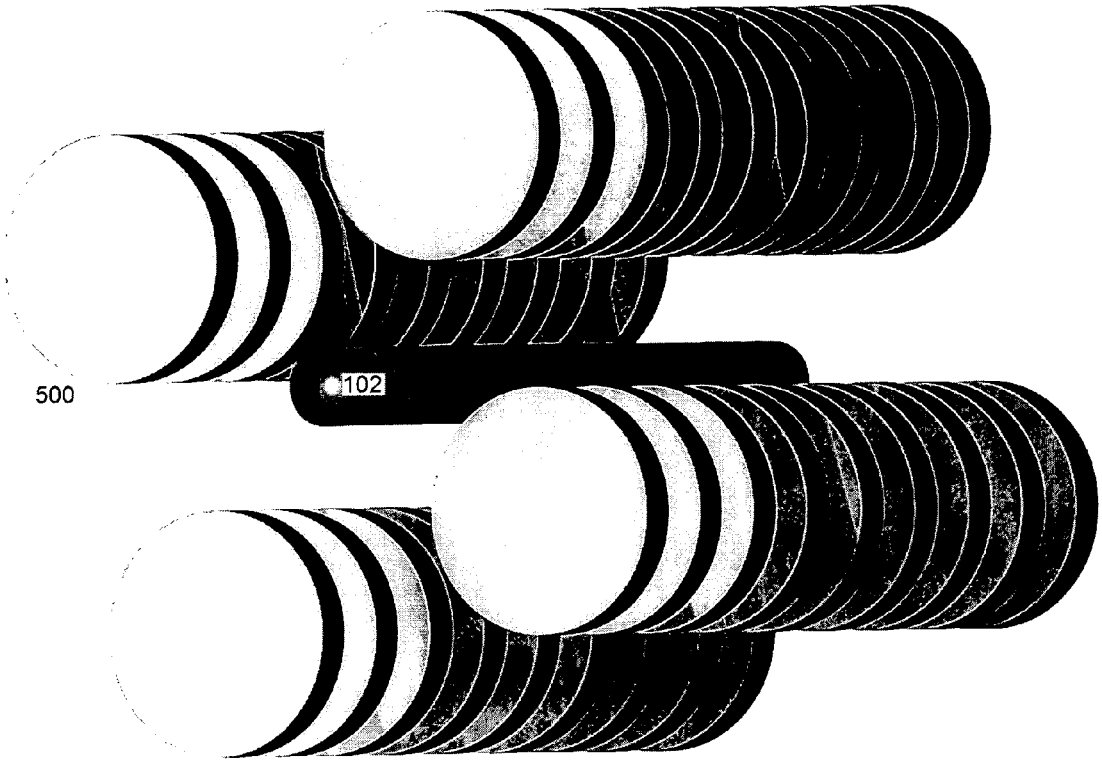
Figure 5: Electrostatic quadrupole electrodes surrounding a distribution of charged particles.
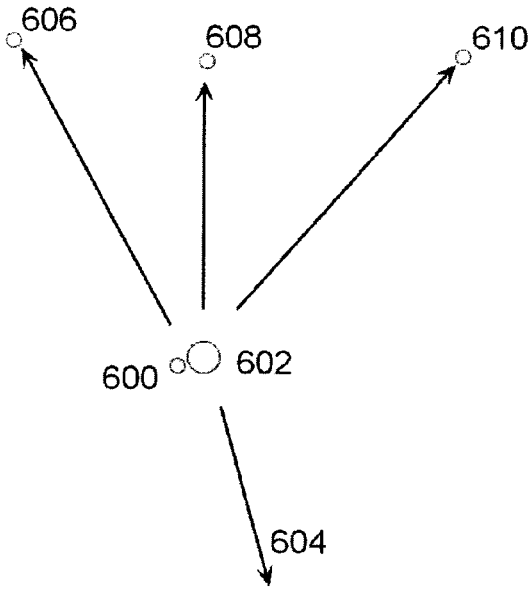
Figure 6: Annihilation of antiprotons with gas molecules, producing secondary particles.

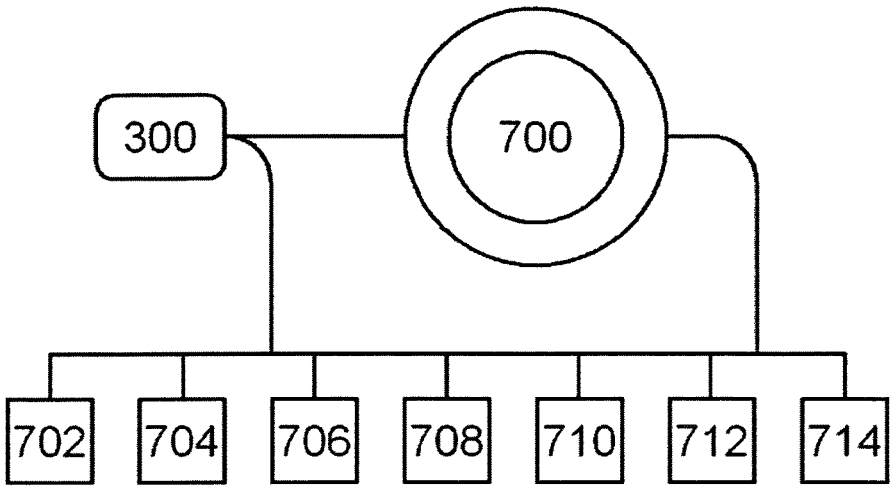
Figure 7: Schematic flow chart of the methods of use of antiprotons extracted from a bottle used to store and transport charged particles.
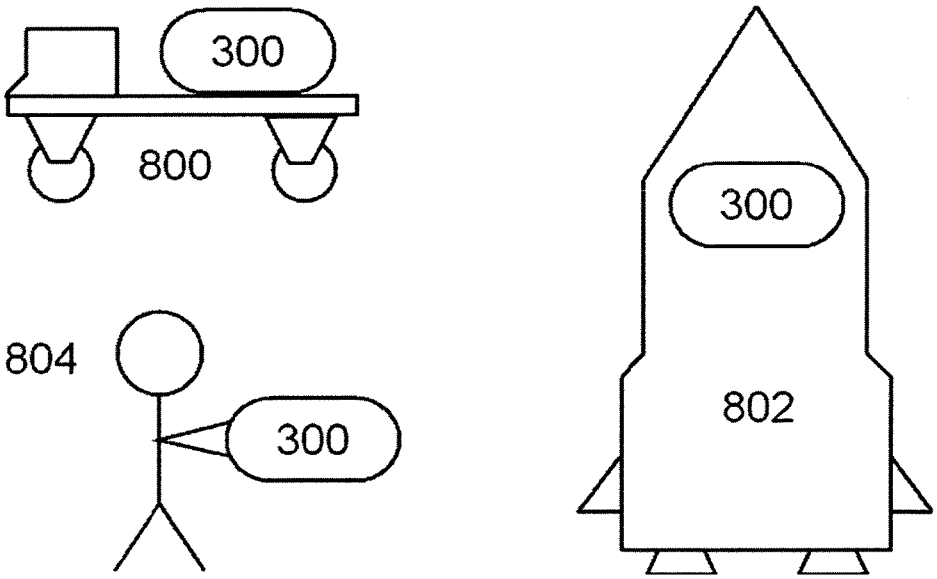
Figure 8: Illustration of several methods of transporting a bottle used to store charged particles.

CONTAINING/TRANSPORTING CHARGED PARTICLES

I. CONTINUITY STATEMENT

The present patent application claims benefit from and incorporates by reference from Ser. No. 60/731,971, filed Oct. 31, 2005.

II. BACKGROUND OF THE INVENTION

A. Field of the Invention

Embodiments herein relate to the field of charged particle storage and transportation. More particularly, embodiments relate to apparatus and method of storing and transporting charged particles, as well as preparing, filling, and transporting a bottle capable of storing and transporting charged particles utilizing electrostatic containment. More specifically, the present invention addresses the collection and storage of antiprotons; and the transport of antiprotons.

B. Background of the Invention

Antiprotons are annihilated upon contacting matter, and containers (e.g., Penning traps) include: "Container for Transporting Antiprotons," U.S. Pat. No. 5,977,554 issued to Gerald A. Smith, et al. on Nov. 2, 1999; "Container for Transporting Antiprotons," U.S. Pat. No. 6,160,263 issued to Gerald A. Smith, et al. on Dec. 12, 2000. See also Smith et al's. related U.S. Pat. Nos. 6,414,331 and 6,576,916, all of which are incorporated by reference. U.S. Pat. No. 5,977,554, for example, teaches containing with "means for providing the necessary magnetic fields"; "cryogen or cold wall"; and antiprotons are trapped in a potential well formed between the first and second electric fields (italics added herein.)

III. SUMMARY

While embodiments herein stand on their own, some embodiments reflect removal of that which has previously been considered necessary or otherwise contradict prior teachings.

IV. BRIEF DESCRIPTION OF THE DRAWINGS

FIG. 1 is a three-dimensional representation of a distribution of charged particles surrounded by axisymmetric electrodes.

FIG. 2 is an electrostatic bottle drawing with representative subsystems describing a possible embodiment of an apparatus for storing and transporting charged particles.

FIG. 3 is the calculated electric field distribution associated with the electrostatic bottle in FIG. 2, wherein the electric field is indicated using contours of constant potential.

FIG. 4 is the calculated radial electric field on the central axis of the electrostatic bottle in FIG. 2.

FIG. 5 is a three-dimensional representation of a distribution of charged particles surrounded by electrodes forming an array of electrostatic quadrupoles.

FIG. 6 is an illustration of the annihilation of an antiprotons with a gas molecule, producing secondary particles.

FIG. 7 is a schematic flow chart of the methods of use of antiprotons extracted from a bottle used to store and transport charged particles.

FIG. 8 is an illustration of several methods of transporting a bottle used to store charged particles.

V. MODES

Antiprotons can be generated and used in experimental studies typically performed by using large particle accelerators, such as the Tevatron at the Fermi National Accelerator Laboratory (Fermilab). The Fermilab accelerator complex includes various linear accelerators and synchrotrons to generate antiprotons, to accelerate these antiprotons to very high energies and momenta (typically to 1 TeV), and to collide these antiprotons together with protons. The results of the collisions can be analyzed to provide information regarding the structure and physical laws of the universe.

While these experimental studies of particle physics use antiprotons with very high energies and momenta, other uses of antiprotons, such as the medical use, have relatively small energies and momenta. If the existing sources of antiprotons at such accelerators are to be used as sources of antiprotons for these other fields, the antiprotons have to be decelerated (i.e., energy and momentum of the antiprotons will have to be reduced). Consider the use of the Main Injector at the Fermi National Accelerator Laboratory (FNAL) in Batavia, Ill. as a particle decelerator (instead of its nominal role as an accelerator), and incorporated by reference are U.S. Pat. Nos. 6,838,676 and 6,822,045. In addition, to provide antiprotons to locations that are off-site from the particle accelerators, the antiprotons have to be decelerated sufficiently to enable them to be stored in a portable synchrotron or cyclotron, or trapped in a bottle and transported to other locations.

One embodiment provides means for storing charged particles, such as antiprotons. The means for storing can include an electrostatic means, such as a bottle, and preferably the means for storing can be utilized as a means for transporting. The means for storing can facilitate applications: For example, the treatment of cancerous tissue, the generation of radioisotopes within the body (useful for imaging techniques and therapeutic treatment).

An electrostatic bottle can be comprised of one or more electrodes through which charged particles flow. Each electrode has applied to it a specific voltage. The combination of electrode spacing, voltage, and aperture diameter, coupled with the motion of the charged particles within the bottle, creates a focusing force which constrains the particles from striking any surfaces within the bottle.

As to the particle motion dynamics of the stored antiprotons, the design of charged particle storage rings can rely on the employment of piecewise uniform (and hence integrable) optical elements such as dipole and quadrupole magnets. By using such linear optical elements which have analytic solutions for particle trajectories and amplitude independent stability parameters, particle loss effects such as resonant extraction and dynamic aperture can be controlled or avoided at the design stage of the optical system. In some embodiments, it can be preferable to sharpen the edges of the discrete focusing and defocusing lenses, depending on the preferred integrable solution desired for predicting long-term storage.

By way of a prophetic teaching, a design can employ an optical system composed of tens or hundreds of electrodes. A representative design can be simulated to illustrate synthesis of piecewise integrable electrostatic optical systems. The choice of electrode voltages utilize an accelerator physics approach to storage ring design in which a piecewise integrable optical system can be used to minimize dynamical sources of particle loss.

By way of another prophetic teaching, the optical system can be comprised of axisymmetric electrodes. Alternatively, the optical system can be comprised of electrostatic quadrupoles, employing strong-focusing to generate a net focusing force on charged particles that are moving within the bottle. Also, the optical system can be comprised of both axisymmetric electrodes and electrostatic quadrupoles.

By way of another prophetic teaching, the geometry of the bottle can incorporate a linear array of electrodes, in which the charged particles oscillate across the bottle along the axis of the electrodes. Alternatively, the bottle can contain a ring of electrodes, in which the charged particles continuously circulated round the ring in toroidal geometry.

In order to maximize the storage life of the charged particles within the bottle, the voltage on the electrodes can be slowly modified. This modification can be based on measured properties of the stored charged particles, such as their oscillation frequencies within the focusing electric field.

A vacuum can be used to prevent the stored particles from being lost through chemical reactions, nuclear reactions, or particle-antiparticle annihilation. In order to keep the weight of the bottle low, the skin of the primary vacuum system can be quite thin. If exposed to air, which contains a hydrogen partial pressure of $1.4\times10^{-4}$ Torr liter/cm$^3$, this skin would allow diffusion of hydrogen into the ultra-high vacuum system and reduce the charged particle lifetime in the bottle. A representative solution is to surround a primary vacuum region with a second high vacuum system that is pumped, e.g., with a miniature sputter-ion pump. By reducing the concentration of hydrogen, e.g., nine orders of magnitude, the problem of hydrogen diffusion can be minimized or eliminated.

Near the charged particles, a highly aggressive method of removing residual gas molecules can be surface gettering. The electrodes and other conducting surfaces of the bottle can be comprised of titanium, which is a good getter material. Just before filling the bottle with the charged particles, the getter material can be heated to outgas the material and generate clean surfaces capable of adsorbing sufficient numbers of gas molecules to maintain the vacuum for weeks or months.

To fill bottles, the injection of charged particles can be accomplished by first attaching the bottle to an existing charged particle source, such as an ion source or a particle accelerator. A vacuum gate valve can be used to merge the bottle vacuum with the particle source vacuum. The charged particles are then directed toward the bottle. In order to hold the charged particles within the bottle, the electric field (which prevents stored charged particles from again exiting the bottle) can be briefly modified during the incoming passage of the injected charged particles. Briefly reducing the voltages on the electrodes near the bottle entrance can be a modification that enables charged particle injection.

Extraction of charge particles stored in the bottle can occur with a procedure inverse to that used for charged particle injection. Another embodiment is to slowly lower the electrode voltages near the bottle entrance, allowing the stored charged particles to slowly spill out. These extracted charged particles can be directed into a particle accelerator. The extracted charged particles can be used in medical therapies, for isotope detection, for isotope generation, for the induction of nuclear fission or fusion, for imaging, of for catalyzing chemical reactions.

In some embodiments, antiprotons are stored and transported in the bottle. However, there are applications wherein the antiprotons do not need to be extracted, but rather annihilated within the bottle itself. One way to accomplish such annihilation is by injecting a gas into the bottle. The gas can be hydrogen. Byproducts of this antiproton annihilation are secondary particles and rays. Embodiments herein can use these secondary particles in interrogating a shielded container for nuclear materials.

When a source of electrons is added, the properties of the bottle can be improved. First, an ion-sputter pump functionality is created by ionizing the residual air molecules in the vacuum chamber. Second, the electrons cool the charged particles in order to overcome the intrabeam scattering. Third, the electrons create a space-charge counter-force which allows more charged particles to be stored in the electrostatic bottle.

In addition to the use of electrons to control the temperature of the stored charged particles, changes to select electrode voltages based on measured charged particle positions and velocities can also be used to reduce and maintain the temperature of the stored charged particles.

Power can be used to maintain the electrode voltages, maintain the vacuum within the bottle, and implement technologies for maintaining the temperature of the stored charged particles. Batteries can be used to provide sufficient power to operate the bottle without external power. Under some conditions the operational power level can be less than ten Watts.

The apparatus can be used for transporting charged particles, again herein exemplified as including antiprotons. Because vibrations can occur when transporting on a vehicle or a person, steps can be taken to minimize the relative motion of electrodes within the bottle. This minimization of structural deflections is useful at the oscillatory frequencies of the stored charged particles. The vehicles used for transport can include automobiles, trains, aircraft, and rockets.

Representatively, one way of viewing the teachings herein is as an apparatus used in storing and transporting charged particles. The apparatus can include: an electric field within the apparatus capable of preventing or controlling the charged particles from striking a surface within the apparatus; and a means for maintaining a vacuum within the apparatus in the region of the charged particles. In another way of viewing the teachings herein, there can be a method of storing and transporting charged particles. The method can include generating an electric field within a bottle capable of preventing or controlling the charged particles from striking a surface within the bottle; and maintaining a vacuum within the bottle in the region of the charged particles.

Another embodiment can be phrased as an apparatus for storing (and in some cases transporting) antiprotons. The apparatus can include an electric field within the apparatus capable of preventing or limiting the antiprotons from striking the surface within the apparatus; and a means for maintaining a vacuum within the apparatus in the region of the antiprotons. Yet another embodiment can be articulated as a method of storing and transporting antiprotons, including: generating an electric field within a bottle capable of preventing the antiprotons from striking a surface within the bottle; and maintaining a vacuum within the bottle in the region of the antiprotons.

Representatively, another way of viewing the teachings herein is as an apparatus and/or method of storing charged particles that is devoid of a controllable magnetic field or need therefore. Compare this view with "Container for Transporting Antiprotons," U.S. Pat. No. 5,977,554 issued to Gerald A. Smith, et al. on Nov. 2, 1999 and "Container for Transporting Antiprotons," U.S. Pat. No. 6,160,263 issued to Gerald A. Smith, et al. on Dec. 12, 2000. The realization that the magnetic field used in Penning traps is not required leads to important improvements in container weight and size.

Representatively, yet another way of viewing the teachings herein is an apparatus and/or method of storing charged particles that is devoid of a cryogenic temperature, and/or a container with a cold wall, (and associated thermally conductive supports in thermal connection with said cold wall), and/or dewar associated with the container or need therefore. Compare this view with "Container for Transporting Antiprotons," U.S. Pat. No. 5,977,554 issued to Gerald A. Smith, et al. on Nov. 2, 1999 and "Container for Transporting Antiprotons," U.S. Pat. No. 6,160,263 issued to Gerald A. Smith, et al. on Dec. 12, 2000. In the teachings herein a vacuum is maintained through any of a number of means, including gettering, ion-sputter pumping, and the employment of an envelope vacuum. The realization that cold walls and cryogenic temperatures used in Penning traps are not required leads to important improvements in container weight and size.

Representatively, yet another way of viewing the teachings herein is as an apparatus and/or method of storing charged particles that is devoid of multiple electric fields or need therefore. Compare this view with "Container for Transporting Antiprotons," U.S. Pat. No. 5,977,554 issued to Gerald A. Smith, et al. on Nov. 2, 1999 and "Container for Transporting Antiprotons," U.S. Pat. No. 6,160,263 issued to Gerald A. Smith, et al. on Dec. 12, 2000. In the teachings herein a single electric field, generated by multiple electrodes, can be handled as a single integrated field. The realization that the cryogenic temperatures used in Penning traps is not required leads to important improvements in container weight and size.

Another embodiment can be phrased as an apparatus and/or method of storing and/or transporting antiprotons. These antiprotons are generated when high energy ions strike a target, colliding the ions against the atoms in the target. These collisions cause fragmentation of the ions and atoms, which sometimes re-coalesce in the form of antiprotons. Because of the radiation levels, energy difference between the incident protons and exiting antiprotons, and system complexity of the antiproton capture system, this target is not found within a synchrotron (see, e.g., U.S. Pat. Nos. 5,977,554, 6,160,263, etc.) but rather a separate location within the accelerator complex. These antiprotons can then be decelerated and injected into a portable container. As a prophetic teaching, this portable container with injected antiprotons can be used to generated biomedically useful radioisotopes at the bedside of a patient. Compare this teaching with "Container for Transporting Antiprotons," U.S. Pat. No. 5,977,554 issued to Gerald A. Smith, et al. on Nov. 2, 1999 and "Container for Transporting Antiprotons," U.S. Pat. No. 6,160,263 issued to Gerald A. Smith, et al. on Dec. 12, 2000.

FIG. 1 shows a group of electrodes 100 surrounding a dense distribution of charged particles 102. An apparatus for, and a method of, storing (and transporting) charged particles is illustrated in a teaching manner.

FIG. 2 shows the electric field 200 generated by the electrodes 100. The electric field in FIG. 2 is represented by contours of constant electric potential.

FIG. 3 shows a schematic representation of a possible bottle 300 or other container suitable for storing and transporting those charged particles 102. This apparatus can include one or more electrodes 100 that shape an electric field 200 which, coupled with the motion of the charged particles 102, focuses the charged particles and constrains them from striking any internal surfaces within the bottle 300, such as the electrodes 100 themselves. The voltage on each electrode can be generated by a high voltage power source 302, which in turn can draw the electrical power it needs from a battery 304.

If the charged particles 102 that are stored in the bottle come into contact with residual gas molecules within the vacuum maintained in the bottle, they can be lost through chemical, nuclear, or annihilation reactions. In this embodiment a second vacuum system 306 that acts as a protective envelope around the central primary vacuum system 308 can be implemented. This envelope vacuum system 306 prevents atmospheric hydrogen and other gases from inducing charged particle losses. A gate valve 310 can be used to separate these two vacuum systems. The envelope vacuum can be maintained using a miniature ion-sputter pump 312. The high voltage needed to operate the ion-sputter pump 312 can be generated by a high voltage power source 314, which in turn can draw the electrical power it needs from a battery 304. In order to inject or extract charged particles from the bottle, the internal gate valve 310 and an external gate valve 316 can be opened to allow passage of the charged particles. In this embodiment of the invention, the methods of injection and extraction can take place with these gate valve(s) cycling open and closed just long enough to allow passage of the charged particles. Within this embodiment, the apparatus can include a gate valve(s) that are fast acting.

The primary vacuum 308 can be maintained by constructing the electrodes 100 and primary vacuum vessel 318 from a material that getters residual gas molecules. In this embodiment, the material is titanium.

In this embodiment, the bottle is protected from extreme temperature fluctuations and physical shock by an external shield 320 that can be comprised of soft, thermally insulating material. The electrodes should also be mounted such that they are insulated from external vibrations.

In one embodiment, the radial focusing of the charged particles is generated by axisymmetric radial electric fields 400 that are a direct result of a voltage gradient along the axis of the electrodes 100. FIG. 4 shows a possible radial electric field pattern as a function of distance along the axis of the electrodes 100. In another embodiment, radial focusing is accomplished through the use of alternating gradient electrostatic quadrupoles 500 such as those illustrated in FIG. 5.

The stored charged particles 102 oscillate within the electric field that constrains their motion, such that there are well defined resonant frequencies associated with this motion. Mechanical and electric vibrations and modulations with a non-zero power spectrum near these resonant frequencies can cause these charged particle oscillations to increase in amplitude, which is described as an increase in the charged particle temperature. Different approaches can be used to limit or reverse this temperature rise. In one embodiment, the stored charged particles 102 include electrons which interact with the other stored particles. By continuously replacing hot electrons and allowing thermodynamic interactions between all stored charged particles via Coulomb scattering, the temperature of the stored charged particles can be controlled. In another embodiment, measurement of the oscillatory particle signal on one or more electrodes can be electrically amplified and applied to one or more electrodes to reduce that signal. Continuous application of this procedure can reduce the temperature of stored charged particles, and is called stochastic cooling.

In some embodiments, stored antiprotons 600 are not extracted, but rather annihilated within the bottle itself. One way to accomplish such annihilation is by injecting a gas into the bottle. The gas can be hydrogen. As illustrated in FIG. 6, annihilation occurs when the antiproton interacts with a gas molecule 602. Byproducts of this antiproton annihilation are gamma-rays 604, pi-mesons 606, neutrons 608, and other secondary particles and rays 610.

A container 300 storing charged particles 302 can be used for many applications. Because the charged particle 302 have very low velocities, it is often necessary to extract them from the container 300 and accelerate them in a particle accelerator 700. A preferred embodiment of this invention is to store and transport antiprotons 600 for use in these many applications. As illustrated in FIG. 7, examples of these applications are medical therapies 702, the detection of individual isotopes 704, the generation of isotopes 706, the induction of fission in a variety of materials 708, the induction of fusion in a variety of materials 710, imaging 712, and catalyzing chemical reactions 714. Each of these applications can be performed using charged particles 102 directly from the container 300, or using these charged particles 302 after acceleration in the particle accelerator 700.

The container 300 storing charged particles can be transported in many ways. As illustrated in FIG. 8, a motorized vehicle 800 of some kind can be used. Motorized vehicles with one or more wheels, including automobiles, motorcycles, trucks, and trains can be used. Motorized vehicles such as ships and aircraft can also be used. The transportation of containers 300 storing charged particles can also be implemented using rockets 802 or other vehicles capable of reaching outer space. The transportation of container 300 storing charged particles can also be performed by one or more persons or animals 804 carrying the container 300.

Note that the foregoing is a prophetic teaching and although only a few exemplary embodiments have been described in detail herein, those skilled in the art will readily appreciate from this teaching that many modifications are possible, based on the exemplary embodiments and without materially departing from the novel teachings and advantages herein. Accordingly, all such modifications are intended to be included within the scope of the defined by claims. In the claims, means-plus-function claims are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment fastening wooden parts, a nail and a screw may be equivalent structures.

The invention claimed is:

1. Particle storing apparatus comprising:

a container in which an electrostatic field, and substantially no magnetic field, is restraining charged particles moving in an ultra-high vacuum from striking an internal surface of the container for a half-life of at least 1 hour, said electric field configured to synthesize a piecewise integrable optical system such that said restraining is caused by movement of the charged particles through the electrostatic field.

2. The apparatus of claim 1, wherein motion of the charged particles within the electrostatic field provides three-dimensional focusing that constrains the particles from striking the surface.

3. The apparatus of claim 1, wherein the electrostatic field is shaped by at least one electrode.

4. The apparatus of claim 1, wherein the apparatus provides storage for the charged particles with the electrostatic field being generated by electrode voltage that is constant.

5. The apparatus of claim 1, wherein the apparatus provides storage for the charged particles with the electrostatic field being generated by electrode voltage that is modified based on measured properties of the charged particles.

6. The apparatus of claim 1, wherein apparatus modifies the electrostatic field, based on measured properties of the charged particles, to allow injection of charged particles into the container.

7. The apparatus of claim 1, wherein the apparatus modifies the electrostatic field, based on measured properties of the charged particles, to allow extraction of charged particles from the container.

8. The apparatus of claim 1, wherein the electrostatic field is axisymmetric along a direction of particle motion.

9. The apparatus of claim 1, wherein the electrostatic field is partially comprised of quadrupole fields that provide some of the focusing of the particles.

10. The apparatus of claim 1, further including a linear array of electrodes that maintain motion of the particles in a direction of the linear array.

11. The apparatus of claim 1, further including a toroidal array of electrodes that maintain motion of the particles in an azimuthal direction.

12. The apparatus of claim 9, further including a linear array of electrodes that sustain motion of the particles in a direction of the linear array.

13. The apparatus of claim 9, further including a toroidal array of electrodes that sustain motion of the particles in an azimuthal direction.

14. The apparatus of claim 1, wherein the apparatus provides for modifying the electrostatic field, based on measured properties of the charged particles, during storage of charged particles to maximize their lifetime.

15. The apparatus of claim 9, wherein the apparatus provides for modifying the electrostatic field, based on measured properties of the charged particles, during storage of the particles to maximize their lifetime.

16. The apparatus of claim 1, wherein at least some of said inside surface is comprised of titanium.

17. The apparatus of claim 1, wherein the apparatus shapes the electrostatic field to enable storage of the particles for a half-life exceeding one day.

18. The apparatus of claim 1, wherein the apparatus shapes the electrostatic field to enable storage of the particles for a half-life exceeding one week.

19. The apparatus of claim 1, wherein the surface is comprised of a material that getters residual gas molecules.

20. The apparatus of claim 1, wherein the vacuum is maintained by using ion-sputter pumping.

21. The apparatus of claim 1, wherein the vacuum is maintained by surrounding the vacuum with a vacuum envelope that limits hydrogen diffusion.

22. The apparatus of claim 1, wherein the vacuum is sufficient to enable storage of the particles for a half-life exceeding one hour.

23. The apparatus of claim 1, wherein the vacuum is sufficient to enable storage of the particles for a half-life exceeding one day.

24. The apparatus of claim 1, wherein the vacuum is sufficient to enable storage of the particles for a half-life exceeding one week.

25. The apparatus of claim 1, further including a means for controlling the temperature of the charged particles.

26. The apparatus of claim 25, wherein the means for controlling the temperature includes a stochastic cooling means.

27. The apparatus of claim 25, wherein the means for controlling the temperature includes an electron cooling means.

28. The apparatus of claim 1, further including a portable power source to maintain the electric field during transportation.

29. The apparatus of claim 21, further including a portable power source to maintain pumping on the vacuum envelope.

30. The apparatus of claim 1, wherein the particles include antiprotons.

31. The apparatus of claim 30, further including an injector of a gas.

32. The apparatus of claim 31, wherein the gas is hydrogen.

33. The apparatus of claim 31, wherein the apparatus produces gamma-rays by the stored antiprotons annihilating with the injected gas.

34. The apparatus of claim 31, wherein the apparatus produces pi-mesons by the stored antiprotons annihilating with the injected gas.

35. The apparatus of claim 31, wherein the apparatus produces neutrons by the stored antiprotons annihilating with the injected gas.

36. The apparatus of claim 31, wherein the apparatus produces secondary elementary particles by the stored antiprotons annihilating with the injected gas.

37. The apparatus of claim 3, further including at least one additional electrode.

38. A method of storing particles, the method comprising:

generating an electrostatic field configured to synthesize a piecewise integrable optical system within a container so as to restrain, while substantially no magnetic field restrains, charged particles moving with respect to said electrostatic field from striking an internal surface of the container; and while the charged particles are restrained, maintaining an ultrahigh vacuum in said electrostatic field wherein the charged particles are movingly restrained.

39. The method of claim 38, wherein motion of the charged particles within the electrostatic field provides three-dimensional focusing that constrains the particles from striking the surface.

40. The method of claim 38, wherein the electrostatic field is shaped by at least one electrode.

41. The method of claim 38, wherein the electrostatic field being generated by electrode voltage that is constant when storing particles.

42. The method of claim 38, wherein the electrostatic field being generated by electrode voltage that is modified, based on measured properties of the charged particles, when storing the particles.

43. The method of claim 38, wherein the electrostatic field is modified, based on measured properties of the charged particles, to allow injection of charged particles into the container.

44. The method of claim 38, wherein the electrostatic field is modified, based on measured properties of the charged particles, to allow extraction of charged particles from the container.

45. The method of claim 38, wherein the electrostatic field is axisymmetric along a direction of particle motion.

46. The method of claim 39, wherein the electrostatic field is at least partially comprised of quadrupole fields that provide some of the focusing.

47. The method of claim 38, wherein the electrostatic field is modified, based on measured properties of the charged particles, during storage of the particles to maximize their lifetime.

48. The method of claim 46, wherein the electrostatic field is modified, based on measured properties of the charged particles, during storage of the particles in order to maximize their lifetime.

49. The method of claim 38, wherein the electrostatic field is shaped to allow storage of the particles for a half-life exceeding one hour.

50. The method of claim 38, wherein the electrostatic field is shaped to allow storage of the particles for a half-life exceeding one day.

51. The method of claim 38, wherein the electrostatic field is shaped to allow storage of the particles for a half-life exceeding one week.

52. The method of claim 38, wherein the vacuum is maintained by surrounding the vacuum system with a secondary vacuum envelope.

53. The method of claim 38, wherein the vacuum allows storage of the particles for a half-life exceeding one hour.

54. The method of claim 38, wherein the vacuum allows storage of the particles for a half-life exceeding one day.

55. The method of claim 38, wherein the vacuum allows storage of the particles for a half-life exceeding one week.

56. The method of claim 38, further including controlling temperature of the particles.

57. The method of claim 56, wherein the controlling includes stochastic cooling.

58. The method of claim 56, wherein the controlling includes electron cooling.

59. The method of claim 38, wherein the particles include antiprotons.

60. The method of claim 38, further including extracting the particles.

61. The method of claim 60, further including injecting the particles into a particle accelerator.

62. The method of claim 60, further including producing, with the particles, a therapeutic treatment of a medical condition.

63. The method of claim 60, further including detecting, with the particles, an isotope.

64. The method of claim 60, further including producing, with the particles, an isotope.

65. The method of claim 60, further including inducing, with the particles, nuclear fission.

66. The method of claim 60, further including inducing nuclear fusion.

67. The method of claim 60, further including producing, with the particles, an image.

68. The method of claim 60, further including catalyzing, with the particles, a chemical reaction.

69. The method of claim 38, further including transporting the container with the particles.

70. The method of claim 69, further including cushioning the container from a transportation vehicle to reduce deleterious effects of vibration during the transporting.

71. The method of claim 69, wherein the transporting includes transporting on a motorized vehicle.

72. The method of claim 69, wherein the transporting includes transporting on a rocket.

73. The method of claim 69, wherein the transporting includes transporting by a person.

74. A method for transporting antiprotons to a point of use, the method comprising:

providing an antiproton confinement region devoid of a confining magnetic field;

maintaining said antiprotons confinement region at an ultra-low pressure;

establishing a controllable electrostatic field configured to synthesize a piecewise integrable optical system in said antiproton confinement region;

modifying said electrostatic field, based on measured properties of the charged particles, in restraining said antiprotons in said antiproton confinement region, wherein said antiprotons are restrained by travelling through the electrostatic field;

transporting said antiprotons to a point of use while maintaining said antiproton confinement region at an ultra-low pressure; and modifying said electrostatic field, based on measured properties of the charged particles, to urge said antiprotons from said antiproton confinement region.

75. The method of claim 74, wherein the said antiproton confinement region is maintained above cryogenic temperatures.

76. An apparatus comprising:

a means for injecting antiprotons into a container suitable for transporting antiprotons, said container comprising an electrostatic field configured to synthesize a piecewise integrable optical system, and essentially no magnetic field, restraining the antiprotons from striking an inside surface of said container, wherein said restraining is caused by the antiprotons travelling through the electrostatic field;

a means for maintaining an ultrahigh vacuum within the container in the region of the antiprotons;

a means of for injecting a gas into the container to cause annihilations of said antiprotons, creating secondary particles used to interrogate a shielded container for nuclear materials.

77. An apparatus for transporting antiprotons, the apparatus comprising;

a substantially evacuated cavity in a container not comprising a dewar;

at least one antiproton trap within said cavity, said trap utilizing an electrostatic field, configured to synthesize a piecewise integrable optical system, coupled with motion of antiprotons within said electrostatic field to provide antiproton confinement; and a sealable cavity access port providing access to said substantially evacuated cavity for selective introduction into and removal from the cavity of said antiprotons.

78. A method of transporting a plurality of antiprotons to a desired location, the method comprising:

fastening a container to a source of antiprotons to receive a plurality of antiprotons;

providing an electrostatic field to cause said plurality of antiprotons to move into a passageway integrally formed within said container;

using said electrostatic field, configured to synthesize a piecewise integrable optical system, coupled with antiproton motion within said electrostatic field, but without using substantially any magnetic field, to trap said plurality of antiprotons;

detecting aid antiprotons;

cooling said antiprotons;

delivering the container to the desired location.

79. Particle transporting method including:

restraining, with an electrostatic field and substantially without a confining magnetic field, charged particles from striking a container surfaces, wherein said restraining is caused by the charged particles travelling through the electrostatic field which is configured to synthesize a piecewise integrable optical system;

maintaining an ultra-high vacuum with said container; and transporting the container.

80. The method of claim 79, wherein the restraining includes restraining with only one electrostatic field.

81. The method of claim 79, wherein the restraining is devoid of more than one electrostatic field.

82. The method of claim 79, wherein the restraining produces a half-life of at least 1 hour.

83. The method of claim 79, wherein the surface is not a cryogenically cold surface.

84. The method of claim 79, wherein the restraining is devoid of more than one controllable electric field.

85. The method of claim 79, wherein the container is not a dewar.

86. The apparatus of claim 1, further comprising a battery to provide power for portable operation of said apparatus, wherein a power level of 10 Watts is sufficient for said restraining and maintaining said vacuum.

* * * * *